US010369076B2

(12) United States Patent
Milante

(10) Patent No.: US 10,369,076 B2
(45) Date of Patent: Aug. 6, 2019

(54) BLISTER SHEET HOLDER FOR THE VERIFICATION OF THE CONTENTS THEREOF

(71) Applicant: ÉcoloPharm Inc., Chambly (CA)

(72) Inventor: Sandrine Milante, Quebec (CA)

(73) Assignee: ECOLOPHARM INC., Quebec (CA)

( * ) Notice: Subject to any disclaimer, the term of this patent is extended or adjusted under 35 U.S.C. 154(b) by 1113 days.

(21) Appl. No.: 13/860,195

(22) Filed: Apr. 10, 2013

(65) Prior Publication Data

US 2014/0305833 A1 Oct. 16, 2014

(51) Int. Cl.
*A61J 1/03* (2006.01)
*A61J 7/02* (2006.01)

(52) U.S. Cl.
CPC *A61J 1/035* (2013.01); *A61J 7/02* (2013.01)

(58) Field of Classification Search
CPC ..... A61J 1/035
USPC ..... 53/167, 235, 255; 206/533, 528, 530, 206/531, 534.1, 538, 539, 570; 221/93, 221/69
See application file for complete search history.

(56) References Cited

U.S. PATENT DOCUMENTS 2,863,572 A * 12/1958 Bethard ..... A61J 7/02 414/675
3,255,894 A * 6/1966 Van Handel ..... A61J 7/02 220/502
3,402,827 A * 9/1968 White ..... A61J 7/02 414/675
3,461,643 A * 8/1969 Strand ..... A61J 7/02 206/539
3,545,164 A * 12/1970 Middleton ..... B65B 5/103 221/156
3,618,751 A * 11/1971 Rich ..... B65D 75/326 206/219
3,775,941 A * 12/1973 Bross ..... B65B 5/103 221/296
3,844,408 A * 10/1974 Relyea ..... B65D 1/22 206/486
3,848,395 A * 11/1974 Totten ..... A61J 7/02 141/246
4,047,620 A * 9/1977 Deininger ..... A61J 7/02 221/266
4,065,000 A * 12/1977 Murton ..... G07D 9/06 414/675
4,158,411 A * 6/1979 Hall ..... B65D 83/0445 206/531
4,261,683 A * 4/1981 Zaleon ..... A61J 7/02 141/334
4,685,271 A * 8/1987 Ringer ..... A61J 7/02 53/246

(Continued)

FOREIGN PATENT DOCUMENTS

CA 2207045 6/1999
CA 2631095 5/2011

*Primary Examiner* — Gloria R Weeks
(74) *Attorney, Agent, or Firm* — Myers Wolin, LLC

(57) ABSTRACT

Embodiments of a holder for a blister sheet used to manage prescription pills are described herein. The holder solves the problem of limited space in filled blisters of a blister sheet during visual verification of the contents thereof by including a frame to receive the sheet in such a way that at least some of the blisters are positioned in close proximity to verification receptacles also provided on the holder to temporarily receive part of the blisters' content.

15 Claims, 5 Drawing Sheets

(56) References Cited

U.S. PATENT DOCUMENTS

D298,968 S * 12/1988 McAllister ..... D15/140
5,038,968 A * 8/1991 Albetski ..... B65B 69/0058 206/531
5,788,079 A * 8/1998 Bouthiette ..... A61J 7/0069 206/534
5,988,429 A * 11/1999 Coe ..... B65D 83/0463 206/531
6,021,623 A 2/2000 Bouthiette
6,023,916 A * 2/2000 Bouthiette ..... A61J 7/0069 206/534
6,338,408 B1 * 1/2002 Anderson ..... A61J 1/035 206/1.5
6,435,230 B2 * 8/2002 Wurst ..... B65G 47/1457 141/144
6,457,611 B1 * 10/2002 Koehler ..... G07F 17/0092 141/243
6,761,010 B1 * 7/2004 Gibson ..... A61J 7/0084 53/246
6,821,079 B2 * 11/2004 Priebe ..... A61J 7/02 414/675
6,899,311 B1 * 5/2005 Ternus ..... F16M 11/10 248/454
7,264,137 B2 * 9/2007 Drought ..... B65D 83/0463 221/25
D558,603 S 1/2008 Priebe et al.
7,334,699 B2 * 2/2008 Keffeler ..... G07F 11/04 221/156
7,779,614 B1 * 8/2010 McGonagle ..... A61J 1/035 53/238
7,802,683 B2 * 9/2010 Bourque ..... A61J 1/03 206/528
7,806,270 B2 * 10/2010 Seibert ..... B65D 25/04 206/528
8,066,124 B2 * 11/2011 Koh ..... A61J 7/02 206/518
8,118,944 B2 * 2/2012 Fay ..... B08B 5/04 134/21
8,291,679 B2 * 10/2012 Bourque ..... A61J 1/03 206/539
8,607,983 B2 * 12/2013 Niven ..... A61J 1/035 206/538
8,757,381 B2 * 6/2014 Bouthiette ..... B65D 1/34 206/528
2006/0138158 A1 * 6/2006 Drought ..... B65D 83/0463 221/25
2011/0214392 A1 * 9/2011 Niven ..... A61J 1/035 53/375.9
2012/0006950 A1 * 1/2012 Vandiver ..... F16M 11/10 248/176.3
2013/0075418 A1 * 3/2013 Sack ..... A61J 7/0076 221/93
2013/0271374 A1 * 10/2013 Edenborough ..... G06F 3/0208 345/168

* cited by examiner

BLISTER SHEET HOLDER FOR THE VERIFICATION OF THE CONTENTS THEREOF

BACKGROUND

The present disclosure relates to pills management.

More specifically, the present disclosure relates to a blister sheet holder for the verification of the blister sheet's content.

It is known in the art of pills management and distribution to use container-defining sheet also called blister sheet. Such sheet includes cavities, arranged in line and columns, that represent moments in days and that can be filled with prescription pills for subsequent ordinate distribution to a user. The blister sheet is then sealed by a sheet that is inscribed with information pertaining to the pills in each cavity. The sealed blister sheet is such that, during distribution of the pills, each cavity can be conveniently detach.

In order to facilitate the filling and sealing operations by the professional, the blister sheet is mounted in a support or holder that is essentially provided to add stability to the blister sheet during these operations.

Examples of conventional blister sheet and support thereof are described in Canadian Patent No. 2,207,045, issued to Dispill Inc. in Jun. 1, 2009 and titled "Kit and Process for the Manufacture of a Set of Individual Pill Containers".

In most jurisdictions, it is legally required that the pharmacist checks the content of the ampoules/blisters to ensure the adequacy of their filling. The conventional supports for blister sheets are not adapted to this duty of the professional pharmacists work.

Indeed, when a great number of pills are inserted in a single cavity, the professional has a hard time identifying and counting the pills therein. The professional checking the prescription in such a filled cavity is often forced to play hide and seek with the pills. This may lead to misidentification of pills and most of the time to a waste of time.

SUMMARY

An object of illustrated embodiments of a blister sheet holder is to provide means to improve the verification of the prescription pills contents in a blister sheet prior to its sealing.

Another object is to provide means to support a blister sheet and to ease the verification of its contents.

More specifically, the problem of limited space in filled blisters of a blister sheet during visually verifying the contents thereof is solved by using a holder to receive the sheet in such a way that at least some of the blisters are positioned in close proximity to verification receptacles provided on the holder to temporarily receive part of the blisters' content.

In accordance with an illustrative embodiment, there is provided a blister sheet holder comprising:

a frame adapted for receiving a blister sheet; and at least one verification receptacle adapted to receive part of a content of at least one blister of the blister sheet; the at least one verification receptacle being mounted to the frame in such a way as to be positioned in close proximity to the least one blister when the blister sheet is received in the frame.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements.

The expression "blister sheet" is to be construed herein as a plurality of small containers assembled into a sheet, without restriction as to the material of the sheet or of the containers or how such a sheet is intended to be sealed or closed. The "blisters" should be construed herein as the containers included on the blister sheet.

The expression "receptacle" is to be construed herein to include a device, etching, engraving or groove portions of an object, or else, that is capable of receiving and holding one or more small objects, such as without restrictions medication pills.

Other objects, advantages and features will become more apparent upon reading of the following non-restrictive description of illustrative embodiments thereof, given by way of example only with reference to the accompanying drawings.

DETAILED DESCRIPTION

Figure 1:
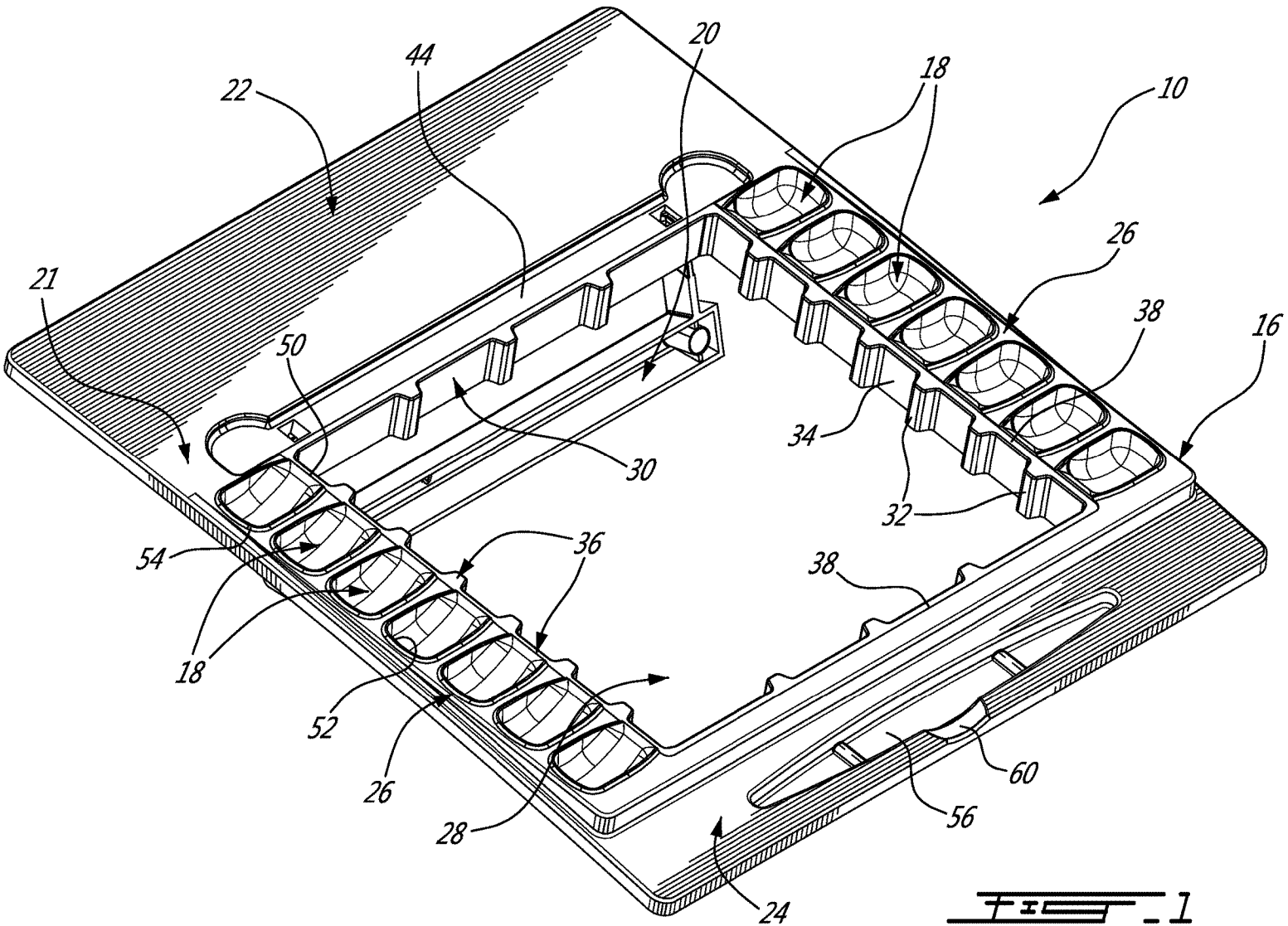
FIG. 1 is a top perspective view of a blister sheet holder according to a first embodiment, the holder being illustrated with its trestle deployed.

A holder 10 for a blister sheet 12 according to a first illustrative embodiment will be described with reference to FIGS. 1 to 2. According to the illustrated embodiment, the blister sheet 12 is of the type used for receiving and distributing prescription pills 14.

The holder 10 comprises a frame 16, two series of receptacles 18 integrally formed in the frame 16 and a foldable trestle 20 pivotably mounted to the frame 16 thereunder.

The frame 16 is generally rectangular in shape and defines a working surface 21 on the side thereof that includes the openings of the receptacles 18. The working surface 21 of the frame 16 includes top 22, bottom 24 and side portions 26 together defining a generally rectangular blister-sheet receiving opening 28 therebetween.

The configuration and size of the frame 16 is adapted to receive and support the blister sheet 12. More specifically, the inner portion of the frame 16 includes a downwardly extending serrated flange 30. The flange 30 is configured to receive the blister sheet 12 in a complementary way.

The flange 30 is provided with ridges 32. The gap 34 between two of the ridges 32 defines a blister receiving portion. According to the illustrated embodiment, the blister sheet 12 includes a matrix of seven (7) rows by four (4) columns of blisters 34 and 34'. The flange 30 includes ridges 32 on all its sides that are numbered and configured to complement the blisters 34 and 34'. The frame 30 can of course be modified to accommodate a blister sheet having another configuration (not shown).

Depending for example on the configuration of the blister sheet 12, the ridges 32 and/or flange 30 can be omitted. In such a case, the peripheral edge of the frame 16 around the blister-sheet receiving opening 28 provides sufficient contact with the blister sheet to restrict its movement therein.

However, it has been found that providing ridges 32 that define blister-receiving portions and that are configured to receive the blisters 34-34' in a snugly-fit manner greatly improves the stability of the sheet 12 in the holder 10.

The top edge 36 of the flange 30 is recessed with regards to the side portions 26 of the frame 16 and with top and bottom portions 22 and 24 so as to define a shoulder 38 that is configured to circumscribe the peripheral edge 42 of a blister-sheet 12 when it is received in the opening 28. The top edge 36 and shoulder 38 further contribute to stabilizing a blister sheet 12 mounted in the opening 28.

It has been found that an opening 28 that is circumscribed by i) a flange 30 that is complimentary to the blister arrangement of the blister sheet 12 and ii) a peripheral recess 36 around the flange to receive the peripheral portion of the blister sheet flange 37 yields a blister-sheet receiving opening 28 that both circumscribes and stabilizes the sheet 12 in the holder 10. This has been found advantageous when a sealing sheet (not shown) is fixed onto the blister sheet 12 to seal the blisters' openings.

The top portion 22 of the frame 16 includes an elongated groove 44 adjacent the top portion of the shoulder 38. The groove 44 is configured and sized to complement the top edge of the blister sheet 12. According to the illustrated embodiment, the top edge of the blister sheet 12 is defined by a tab 46 that extends throughout the width of the sheet 12 and that ends with two hooks 48.

In the present, the expressions "top" and "bottom" are used with reference to the frame 16 to help distinguish between the portion further away from the user during normal use of the holder 10 ("top") and the portion nearest the user ("bottom").

Each side portion 26 of the frame 16 includes a series of oval-shaped recesses that define the receptacles 18. The receptacles 18 are positioned in two columns, one on each side 26 of the frame 16. The number and positions of the receptacles 18 within a column is such that each receptacle 18 is registered with a corresponding row of blisters 34-34' on the sheet 12.

Each recess 18 has a depth that increases from a first side 50 of the recess 18 adjacent the shoulder 38 towards the opposite side 52 of the recess. More specifically, the first side 50 is generally leveled with the upper portion of the shoulder 38 so as to be generally leveled with the top surface or flange 37 of a sheet 12 mounted in the opening 38. A peripheral ridge 54 is provided all around each receptacle 18 except on the first side 50 thereof. The advantageous configuration of the receptacles 18 will be further explained hereinbelow with reference to the operation of the holder 10.

Returning to the configuration of the working surface 21, the configuration and size of the top portion 22 of the frame 16 can be adapted to the size of the sheet (not shown) used to seal the blister sheet. More specifically, the top portion 22 is dimensioned to support an overdimensioned portion of the sealing sheet at the top thereof. Such an overdimensioned portion is used to add information pertaining to the blister sheet contents.

The bottom portion 24 of the working surface 21 includes a second groove 56 for receiving and storing a pill sorting tool 58. The bottom portion 24 further includes a recessed portion 60 contiguous to the groove 56 to ease manual access to the tool 58 in the groove 56.

The bottom portion 24 is recessed relative to the side portions 26 so as to yield a shoulder 62 that extends over the width of the frame 16. The shoulder 62 allows minimizing inadvertent intrusion of the tool 58 when it is moved in or out of the groove 56.

Figure 2:
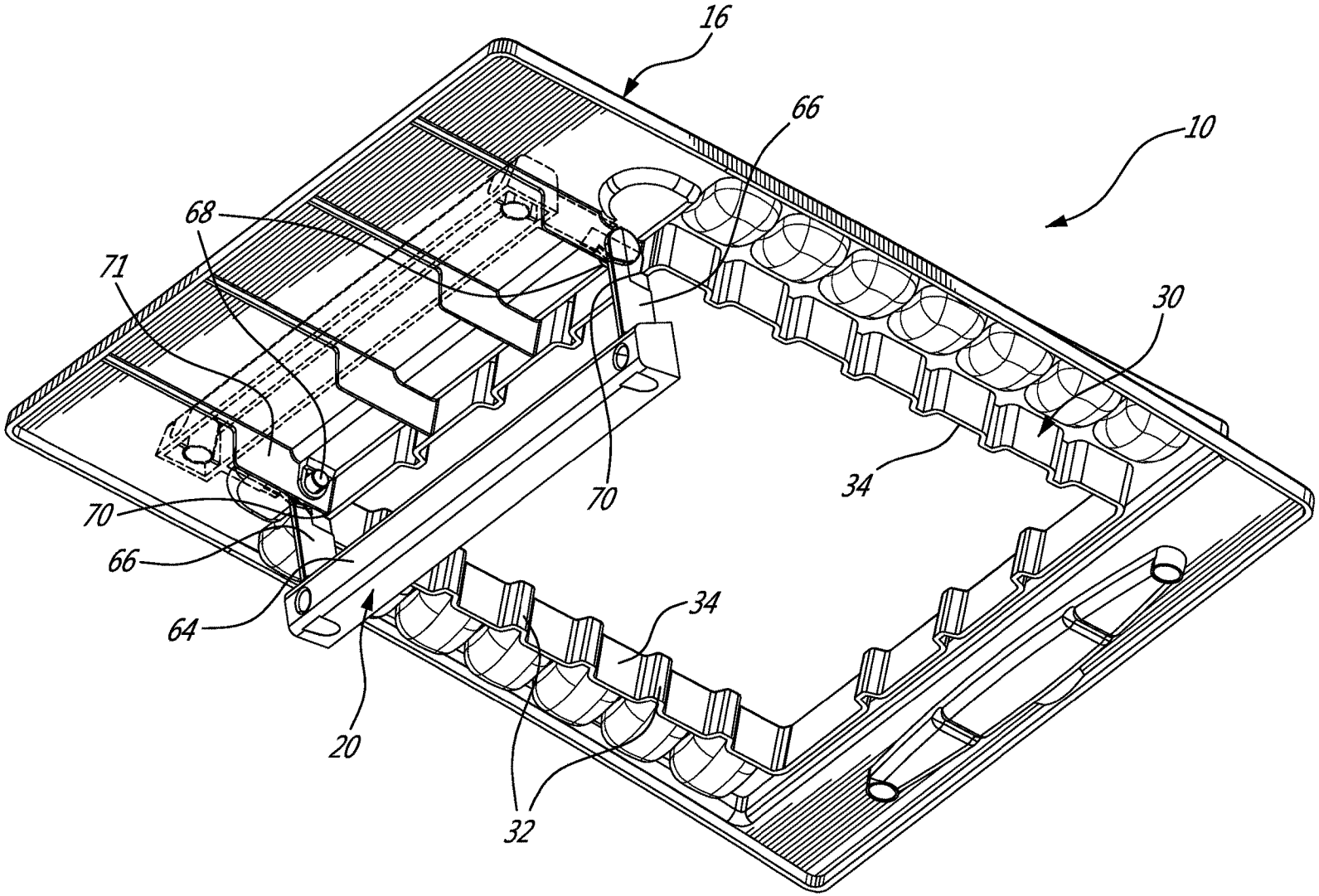
FIG. 2 is a bottom perspective view of the blister sheet holder from FIG. 1.
Figure 3:
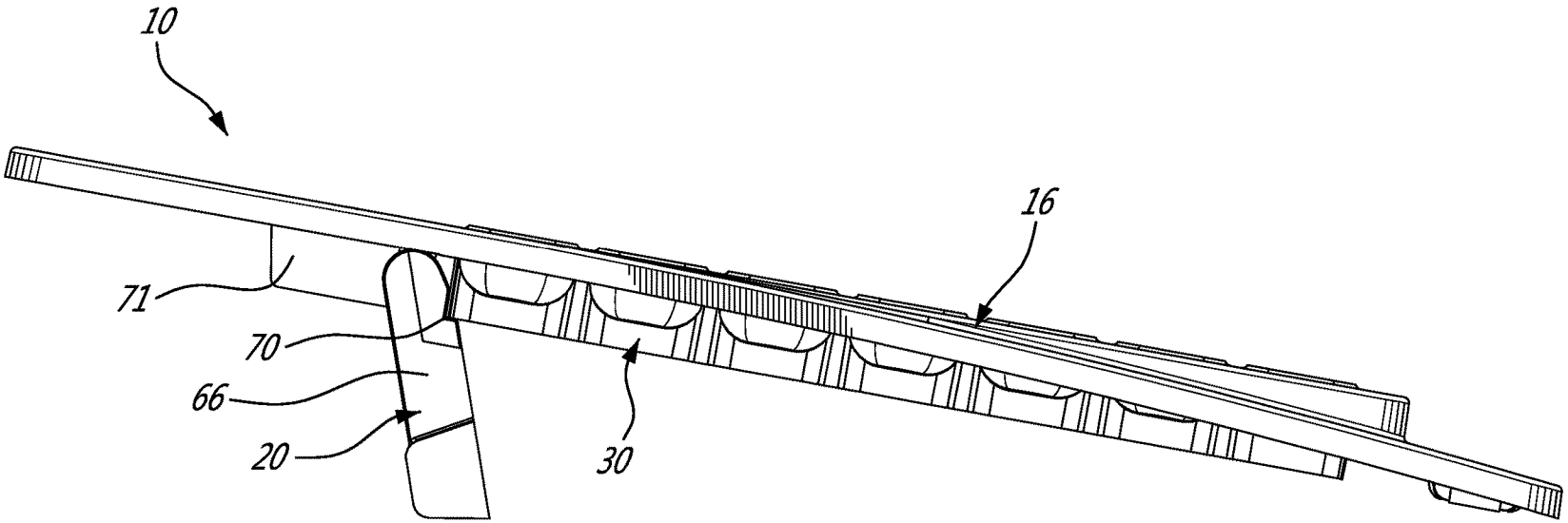
FIGS. 3 and 4 are side elevations of the blister sheet holder from FIG. 1, showing respectively deployed and folded positions of the trestle.
Figure 4:
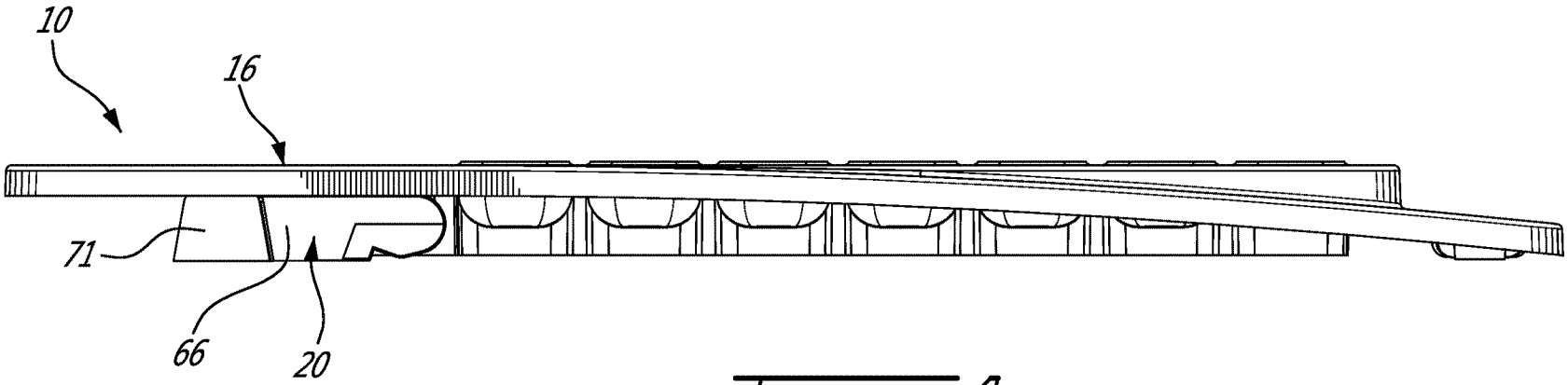

Turning now to FIGS. 2-4, the trestle 20 will now be described in more detail.

The trestle 20 is in the form of an elongated C-shaped member that includes a rod 64 having a rectangular section for resting on a surface (not shown) and two connecting arms 66 that integrally extend from the rod perpendicularly therefrom. The distal ends of the arms 66 are provided with pivot pins 68 that allow detachably mounting the arms 66 in holes 69 provided under the frame 16 so as to allow pivotal movements of the arms relative to the frame 16. The holes 69 are located in fins 71 that extends from the flange 30 adjacent the flange 30 under the top portion 22 of the frame 16. The trestle 66 is therefore pivotally mounted to the frame 16 for movement between folded and deployed positions relative to the frame 16.

As can be seen in FIG. 3, which illustrates the deployed position of the trestle 20, each of its arms 66 includes a notch 70 that abuts onto the flange 30 and blocks the pivoting movement of the trestle 20 in its deployed position. The arms 66 then define an angle of about seventy (70) degrees with the frame 16. This tilts the frame 16 to about ten (10) degrees. Such tilting of the frame 16 by raising its top portion 22 has been found to ease the filling and then content verification of the blisters 34-34'. Moreover, tilting the arms 66 towards the flange 30 improves the stability of the holder 10 during its use.

The arms 66 of the trestle 20 are configured and sized so as to become an extension of the flange 30 under the top portion 22 of the frame 16 when the trestle 20 is tilted to its folded position (see FIG. 4).

A holder according to another embodiment can be configured so that the trestle tilts the frame to a different angle than the one illustrated. According to still another embodiment, the trestle 20 is omitted. According to this last embodiment, the flange 30 or other portions or members under the frame 16 can be provided to raise the top portion of the frame relative the bottom portion thereof.

Figure 5:
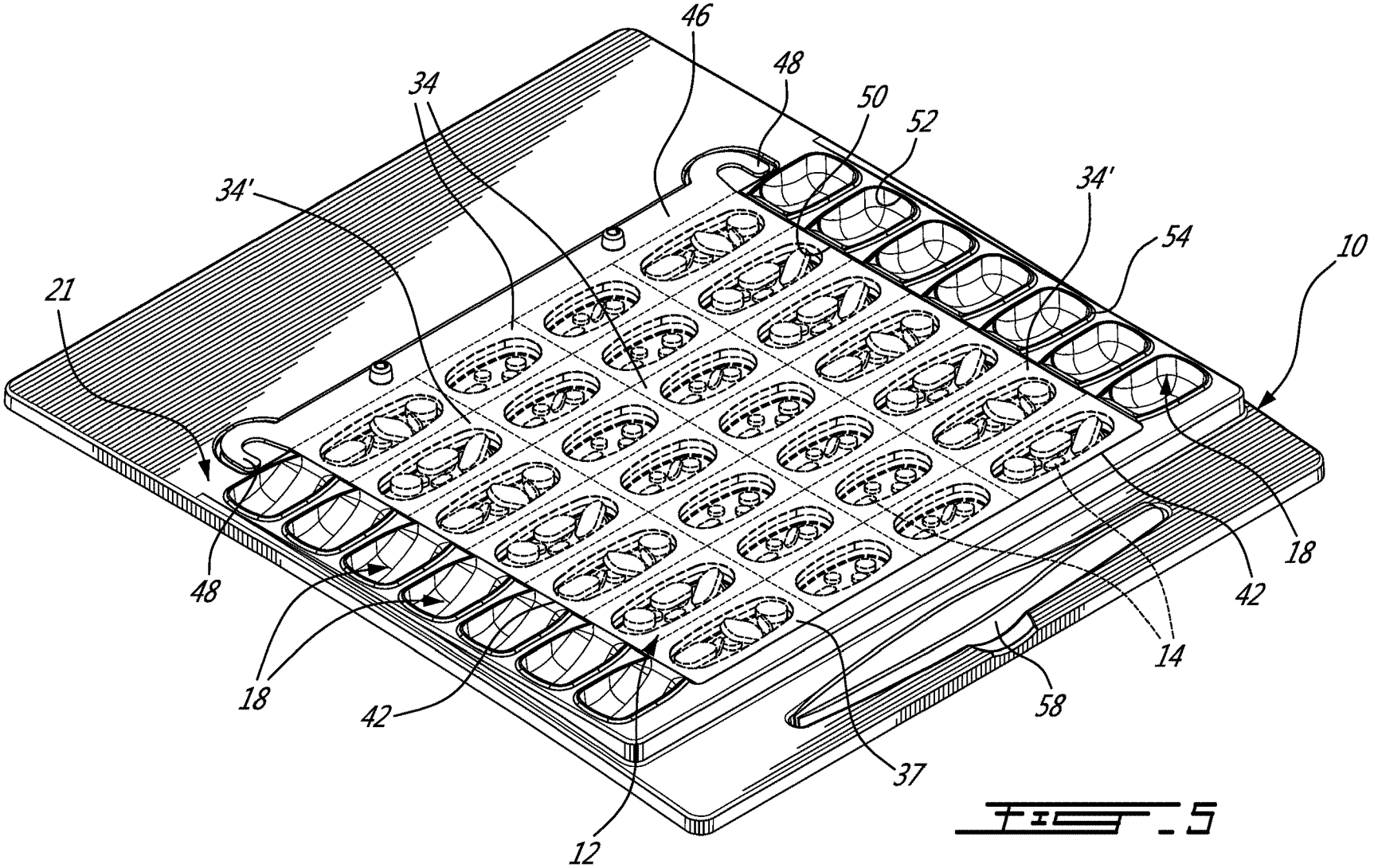
FIG. 5 is a perspective view of the blister sheet holder from FIG. 1, further showing therein an embodiment of a blister sheet filled with prescription pills.

FIG. 5 illustrates the holder 10 with a blister sheet 12 mounted thereinto. As mentioned hereinabove, the frame 16 can be modified to receive a blister sheet having a different configuration (not shown) then the one illustrated.

Figure 6:
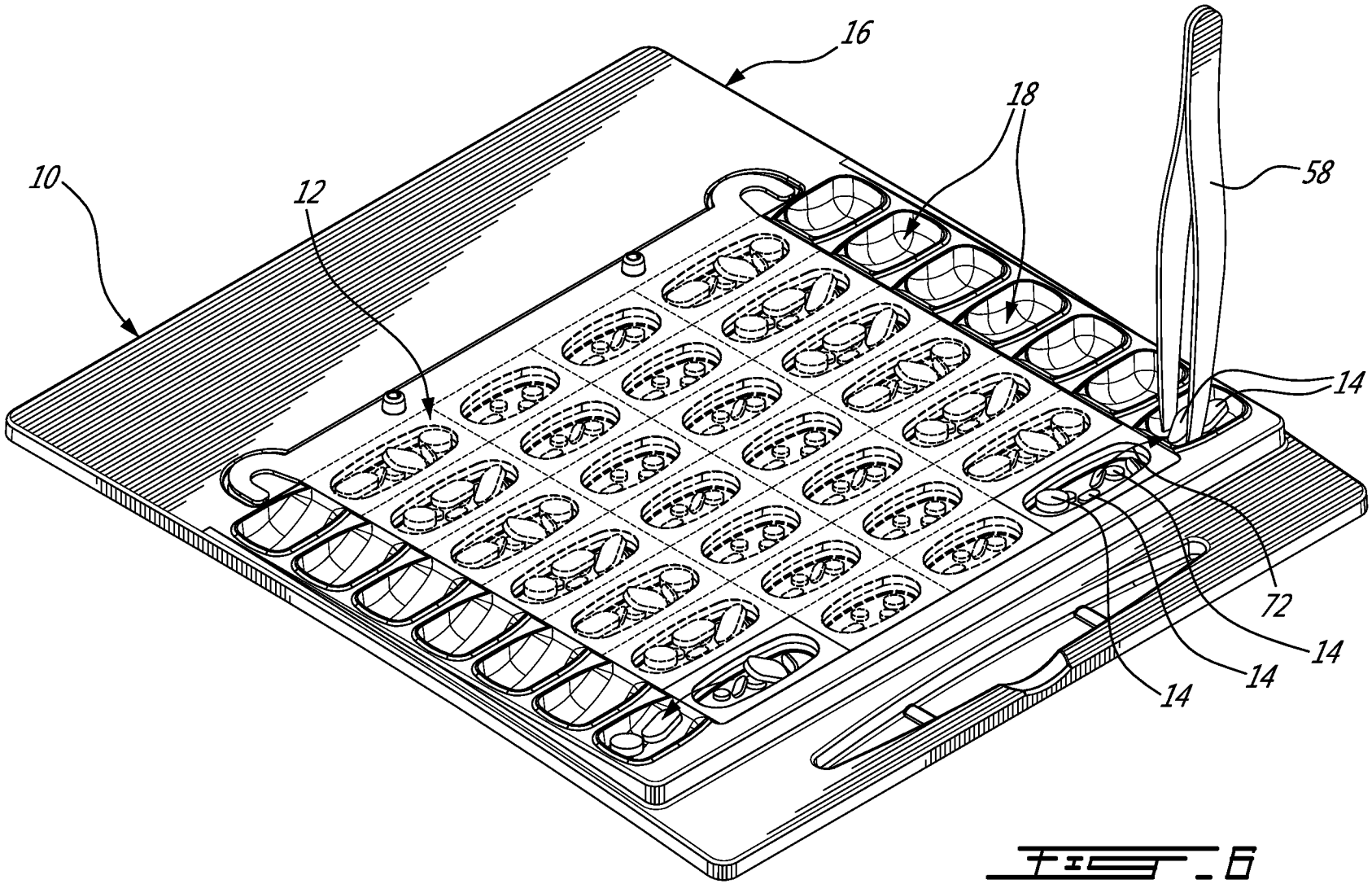
FIG. 6 is a perspective view similar to FIG. 5, further illustrating the use of the receptacles to better distinguish a blister's content during verification thereof.

As can be seen in FIG. 6, the receptacles 18 are filled with a certain number of pills 14 that can have different colors, sizes and shapes, as determined for example by a prescription. The illustrated embodiment of a blister sheet 12 is configured with seven (7) rows, one for each day of the week, and four (4) column, each for a different moment in day, such as morning, lunch, dinner and night.

As is often the case for an elder, the morning and night prescriptions usually include an important number of pills 14 or bigger pills compared to other moments of the day.

Using for example the tool 58, the pharmacist or another authorized professional (both not shown), can transfer part of a blister 34' from a first or last column of the blister sheet 12 into the receptacle 18 which is adjacent thereof (see arrows 72). This is illustrated in FIG. 6. As a person skilled in the art would appreciate, the verification process becomes easier in such a blister 34' that has been relieved of part of its content. Part of a blister 34 from the middle of the sheet 12 can also be transferred into one of the receptacles 18 during the verification step.

The risk of losing one of the pills 14 during the transfer from a blister 34' into the adjacent receptacle 18 is minimized by the close proximity of the receptacles 18 to adjacent blisters and by the side of the receptacle 18 adjacent the blisters being generally leveled with the blisters flange 37. Also, the transfer back of pills from a receptacle 18 to an adjacent blister 34' is facilitated by the receptacle inner surface being smooth, i.e. free of any edge.

Since filling and sealing blisters are believed to be well-known in the art, those steps in the managing of a prescription will not be described herein in more detail for concision purposes.

According to the illustrated embodiment, the frame 16 is one-piece and results from a moulded process. Since such moulding processes are believed to be well-known in the art, they will not be described herein in more detail for concision purposes. The holder 10 can be made of a polymeric material such as polypropylene, abs (acrylonitrile-butadiene-styrene), polystyrene plastic or of another material or combination of materials that provides rigidity to the frame 16.

The receptacles 18 are not limited to be integral to the frame 16. Also, the frame 16 can be assembled from parts and/or the receptacles 18 can be attached to the frame 16. According to another embodiment, the receptacles are removably mounted to the frame.

It is to be noted that other modifications could be made to the holder 10 described hereinabove, for example:

- the blister sheet receiving portion 28 of the frame 16 is not limited to the rectangular shape and is generally configured to complement the peripheral shape of the blister sheets so as to prevent movement of the blister sheet relative to the frame;
- the receptacles are not limited to the illustrated oval shape. They can be round, rectangular, teardrop shaped, irregular, etc.;
- the receptacles are also not limited to having a smooth surface therein;
- the number, dimensions, and positions of the receptacles 18 are not limited to the illustrated embodiment. For example, the frame 16 can be modified to include verification receptacles above and below the blister-sheet receiving opening 28. In the case of receptacles being provided above the blister-sheet receiving opening, such receptacles can be provided above the groove 44;
- the holder is not limited to receiving a blister-sheet intended to receive pills therein. More generally, it can be used for receiving a blister-sheet that receives other small objects or matter whose number and/or nature require a verification.

It is to be understood that the holder for blister sheets is not limited in its application to the details of construction and parts illustrated in the accompanying drawings and described hereinabove. The holder is capable of other embodiments and of being practiced in various ways. It is also to be understood that the phraseology or terminology used herein is for the purpose of description and not limitation. Hence, although the holder for blister sheets has been described hereinabove by way of illustrative embodiments thereof, it can be modified, without departing from the spirit, scope and nature of the subject invention.

What is claimed is:

1. A blister sheet holder comprising:

a frame defining an opening adapted for receiving a blister sheet; and verification receptacles in the frame, each adapted to receive part of a content of at least one blister of the blister sheet; each of the verification receptacles being positioned adjacent to and outside of a boundary of the opening defined by a length and width of the opening, and wherein at least one of the verification receptacles includes a bottom surface that has a depth that gradually increases from a first side of the at least one of the verification receptacles that is adjacent to and outside of the boundary of the opening to another side of the at least one of the verification receptacles.

2. The blister sheet holder of claim 1, wherein the depth on the first side corresponds to an opening of the least one of the verification receptacles on the first side thereof.

3. The blister sheet holder of claim 1, wherein at least some of the verification receptacles are aligned.

4. The blister sheet holder of claim 1, wherein the opening is configured for complementary receiving the blister sheet.

5. The blister sheet holder of claim 1, wherein the frame includes a flange that surrounds at least part of the opening.

6. The blister sheet holder of claim 5, wherein the flange includes ridges that define gaps therebetween for receiving blisters of the blister sheet in a snugly-fit manner.

7. The blister sheet holder of claim 1, wherein at least one of the verification receptacles has a smooth inner surface.

8. The blister sheet holder of claim 1, wherein the opening defined by the frame is rectangular.

9. The blister sheet holder of claim 8, wherein at least some of the verification receptacles are aligned along a side edge of the frame.

10. The blister sheet holder of claim 1, wherein at least one of the verification receptacles is in the form of a recess in the frame.

11. The blister sheet holder of claim 1, wherein the frame is tilted.

12. The blister sheet holder of claim 1, further comprising a trestle mounted to the frame for tilting the frame.

13. The blister sheet holder of claim 12, wherein the trestle is movable between a folded position and a deployed position wherein the frame is tilted.

14. The blister sheet holder of claim 1 further comprising a tool receiving receptacle in the frame.

15. A blister sheet holder comprising:

a frame that defines a rectangular opening for complementary receiving a blister sheet; the frame including smooth integral recesses on opposite sides of the rectangular opening; each recess being adjacent to and outside of a boundary of the opening, and including a bottom surface having a gradually increasing depth from a first side of the recess adjacent the rectangular opening to a second side opposite the first side.

* * * * *